US012151274B2

(12) United States Patent
Ageba

(10) Patent No.: US 12,151,274 B2
(45) Date of Patent: Nov. 26, 2024

(54) PRESS FORMING METHOD

(71) Applicant: JFE STEEL CORPORATION, Tokyo (JP)

(72) Inventor: Ryo Ageba, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 253 days.

(21) Appl. No.: 17/926,685

(22) PCT Filed: Mar. 8, 2021

(86) PCT No.: PCT/JP2021/008866
§ 371 (c)(1),
(2) Date: Nov. 21, 2022

(87) PCT Pub. No.: WO2021/240941
PCT Pub. Date: Dec. 2, 2021

(65) Prior Publication Data

US 2023/0191469 A1 Jun. 22, 2023

(30) Foreign Application Priority Data

May 23, 2020 (JP) ..... 2020-090155

(51) Int. Cl.
*B21D 22/26* (2006.01)

(52) U.S. Cl.
CPC ..... *B21D 22/26* (2013.01)

(58) Field of Classification Search
CPC ..... B21D 22/02; B21D 22/22; B21D 22/26; B21D 53/88
See application file for complete search history.

(56) References Cited

U.S. PATENT DOCUMENTS 10,596,611 B2 3/2020 Nishimura et al.
2016/0121384 A1 5/2016 Sumikawa et al.
(Continued)

FOREIGN PATENT DOCUMENTS

EP 3 305 429 A1 4/2018
JP 2010-069490 A 4/2010
(Continued)

OTHER PUBLICATIONS

Sep. 12, 2023 Extended Search Report issued in European Patent Application No. 21814523.3.
(Continued)

*Primary Examiner* — Debra M Sullivan
(74) *Attorney, Agent, or Firm* — Oliff PLC

(57) ABSTRACT

A press forming method for forming a press forming part includes: a first forming step of forming a preformed part, the preformed part including a side wall portion, a flange portion formed in a bottom edge being a portion having a large wall depth and a torsional shape portion formed in an inclined side portion continuous from the flange portion to reach a second curved portion; and a second forming step of further processing the preformed part formed in the first forming step, including processes of forming the torsional shape portion into the flange portion and forming the flange portion in the second curved portion continuous from the inclined side portion and in a recessed side portion having a small wall depth so as to achieve formation of a target shape.

3 Claims, 8 Drawing Sheets

(56) References Cited

U.S. PATENT DOCUMENTS

| | | | | |
|---|---|---|---|---|
| 2016/0199897 | A1 | 7/2016 | Otsuka et al. | |
| 2016/0325330 | A1 | 11/2016 | Nitta et al. | |
| 2018/0133778 | A1 | 5/2018 | Tanaka et al. | |
| 2019/0030583 | A1* | 1/2019 | Nishimura ..... | B21D 24/005 |

FOREIGN PATENT DOCUMENTS

| | | | |
|---|---|---|---|
| JP | 6032374 | B2 | 11/2016 |
| WO | 2016/194963 | A1 | 12/2016 |
| WO | 2017/170533 | A1 | 10/2017 |

OTHER PUBLICATIONS

Apr. 27, 2021 International Search Report issued in International Patent Application No. PCT/JP2021/008866.

* cited by examiner

PRESS FORMING METHOD

FIELD

The present invention relates to a press forming method applicable to press forming of a member such as an automotive part from a metal sheet, and particularly relates to a press forming method applicable to press forming parts having a top portion, a side wall portion having a portion in which a wall height changes in a side view, and a flange portion formed on a bottom edge which is a side portion of the side wall portion provided on an opposite side of the top portion.

BACKGROUND

In recent years, in order to achieve weight reduction of automotive body due to environmental problems, high-strength steel sheets have been frequently used for automotive parts. However, a high-strength steel sheet is poor in elongation as compared with a steel sheet having low strength and thus tends to cause fracture during material processing. In addition, when a high-strength steel sheet is used, sheet metal thinning is also performed at the same time for further weight reduction, leading to a problem of high likelihood of occurrence of buckling of the steel sheet and occurrence of wrinkles during press forming. Therefore, development of a press forming method method for suppressing fracture and pressing wrinkles is strongly required.

For example, Patent Literature 1 discloses a press forming method that uses a wrinkle suppression pad (blank holder) driven separately from a punch and a die and makes it possible to manufacture an automotive part which is likely to cause wrinkles and stretch flange fractures inside a product with no forming defectiveness. The method disclosed in Patent Literature 1 is considered to be able to manufacture an automotive part that is likely to cause wrinkles and fractures inside a product without forming defectiveness.

CITATION LIST

Patent Literature

Patent Literature 1: JP 6032374 B2

SUMMARY

Technical Problem

However, the press forming method disclosed in Patent Literature 1 is a method that needs to hold down the inside of the product away from the flange using a wrinkle suppression pad. Therefore, the method has a problem that the technique cannot be applied to a shape having occurrence of wrinkles or fractures in the flange portion itself.

The present invention has been made in view of the above problem, and aims to provide a press forming method applicable to a press forming part having an occurrence of wrinkles and fractures in a flange itself and capable of simultaneously suppressing the wrinkle and fracture occurring in the flange.

Solution to Problem

A press forming method according to the present invention for forming a press forming part, the press forming part including: a top portion; a side wall portion continuous from the top portion, the side wall portion having a recessed portion in which a bottom edge, which is an end on an opposite side of the top portion in a side view, is recessed toward the top portion; and a flange portion formed outward on the bottom edge of the side wall portion, the recessed portion including a first curved portion continuous with the bottom edge being a portion having a large wall depth, an inclined side portion continuous with the first curved portion, a second curved portion continuous with the inclined side portion, and a recessed side portion having a small wall depth, arranged in order from the bottom edge being a portion having a large wall depth, the flange portion being formed such that the flange portion formed in the first curved portion becomes a shrink flange while the flange portion formed in the second curved portion becomes a stretch flange, includes: a first forming step of forming a preformed part, the preformed part including the side wall portion, the flange portion formed in the bottom edge being a portion having a large wall depth and a torsional shape portion formed in the inclined side portion continuous from the flange portion to reach the second curved portion; and a second forming step of further processing the preformed part formed in the first forming step, including processes of forming the torsional shape portion into the flange portion and forming the flange portion in the second curved portion continuous from the inclined side portion and in the recessed side portion having a small wall depth so as to achieve formation of a target shape.

The first forming step and the second forming step may be performed by using different dies.

The first forming step and the second forming step may be performed with one die.

Advantageous Effects of Invention

According to the present invention, occurrence of wrinkles due to shrink flange forming is suppressed in the first forming step, and occurrence of fractures due to stretch flange forming is suppressed in the second forming step, leading to achievement of suppression of occurrence of wrinkles and fractures throughout all steps.

DESCRIPTION OF EMBODIMENTS

Figure 6:
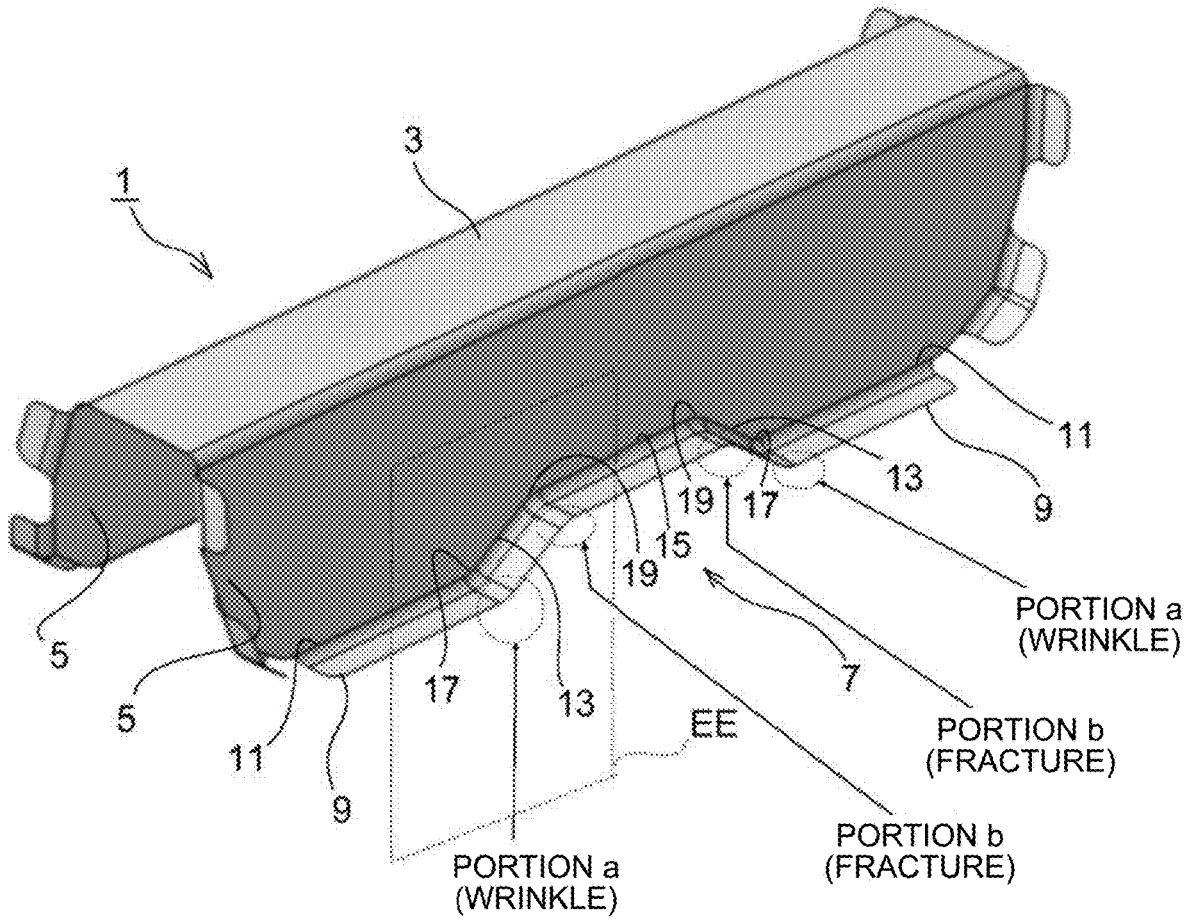
FIG. 6 is a view illustrating a target shape and a problem occurring in a forming process of the target shape according to the embodiment.
Figure 7:
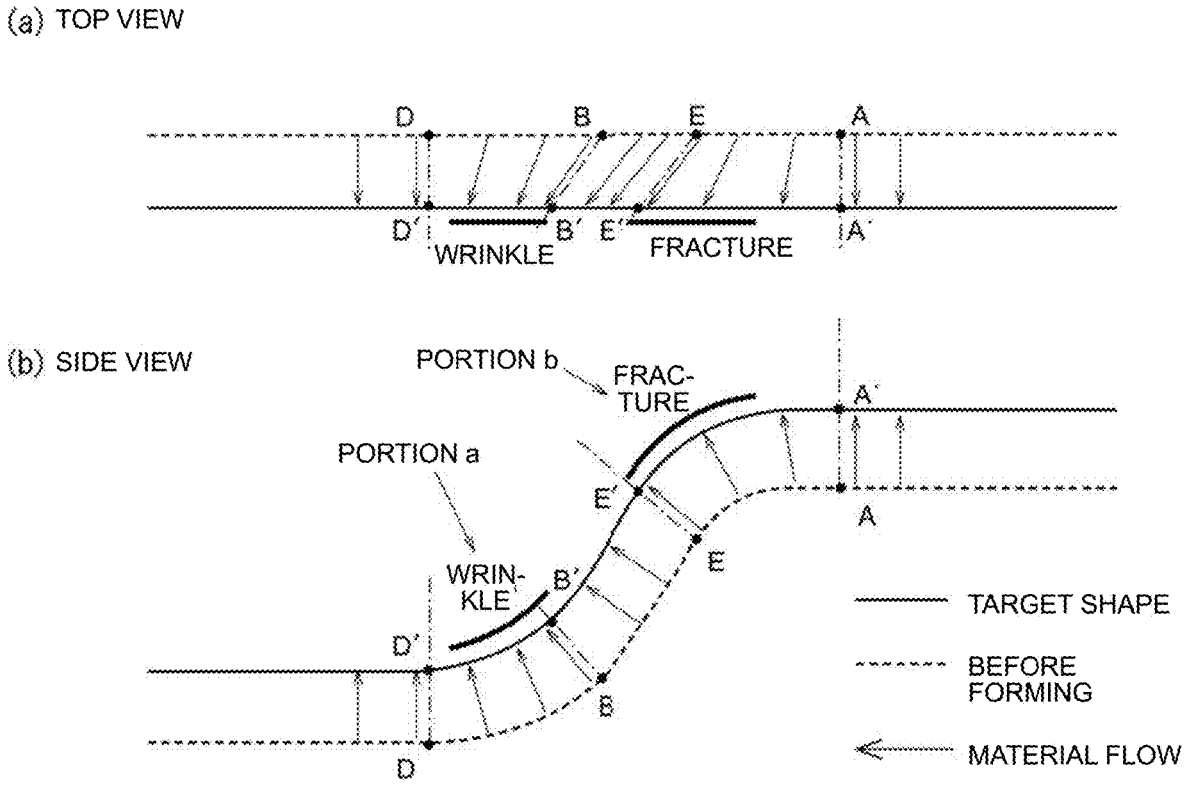
FIG. 7 is a diagram illustrating a mechanism of occurrence of wrinkles and fractures in the forming process of the target shape illustrated in FIG. 6.

Prior to the description of the press forming method according to the present embodiment, an example of a press forming part to be formed in the present invention will be described with reference to FIGS. 6 and 7. A press forming part 1 illustrated in FIG. 6 is a floor front cross member which is an automotive part. The press forming part 1 includes a top portion 3; a side wall portion 5 continuous from the top portion 3, the side wall portion 5 having a recessed portion 7 in which a bottom edge 11, which is a side portion opposite to the top portion 3 in a side view, is recessed toward the top portion 3; and a flange portion 9 formed outward on the bottom edge 11 of the side wall portion 5.

The recessed portion 7 includes: a pair of inclined side portions 13 continuous from the bottom edge 11 being a portion having a large wall depth; and a recessed side portion 15 connecting ends of the inclined side portions 13 and having a small wall depth. There are provided: a pair of first curved portions 17 curved from the bottom edge 11 being a portion having a large wall depth to the inclined side portion 13; and a pair of second curved portions 19 curved from the inclined side portion 13 to a portion having a small wall depth. The flange portion 9 formed in the first curved portion 17 is subjected to shrink flange forming, and the flange portion 9 formed in the second curved portion 19 is subjected to stretch flange forming.

When such a press forming part 1 is formed by a conventional press forming method, wrinkles are likely to occur due to an excess metal in a portion (portion a surrounded by a round broken line in the drawing) that is subjected to shrink flange forming, while fractures due to material shortage are likely to occur in a portion (portion b surrounded by a round broken line in the drawing) that is subjected to stretch flange forming.

A mechanism of occurrence of the wrinkles and the fractures will be described with reference to FIG. 7. FIG. 7 is a diagram illustrating a material flow in the forming process in portion EE surrounded by the square broken line in FIG. 6, illustrating a top view (FIG. 7(*a*)) and a side view of (FIG. 7(*b*)) of FIG. 6. In FIG. 7, a broken line is a tip of the blank before forming, and a solid line is an edge of the flange portion 9 formed into a target shape. In addition, points D and B in the drawing correspond to R-finish of the first curved portion 17 in the blank before forming, and corresponding intersections of lines extending perpendicular to the edge of the target shape from points D and B in the side view and the edge of the target shape are points D' and B'. Similarly, points A and E in the drawing correspond to R-finish (the boundary between a curve and strait line) of the second curved portion 19 in the blank before forming, and corresponding intersections of lines extending perpendicular to the edge of the target shape from points E and A in the side view and the edge of the target shape are points A' and E'. As illustrated in the side view of FIG. 7(*b*), since the material flows substantially perpendicularly to the ridge line (line of bending), the material flows in a direction in which the material gathers in portion a, and flows in a direction in which the material leaves in portion b. Accordingly, wrinkles are likely to occur in portion a, while fractures are likely to occur in portion b.

In order to solve such a problem, the inventors have devised a press forming method in which a preformed part, which facilitates inflow of a material from a portion where shrink flange forming occurs to a portion where stretch flange forming occurs, is interposed in the middle of forming, thereby enabling avoidance of concentration of compressive strain and tensile strain in each of the portions. Specifically, the press forming method has the following configuration.

Figure 1:
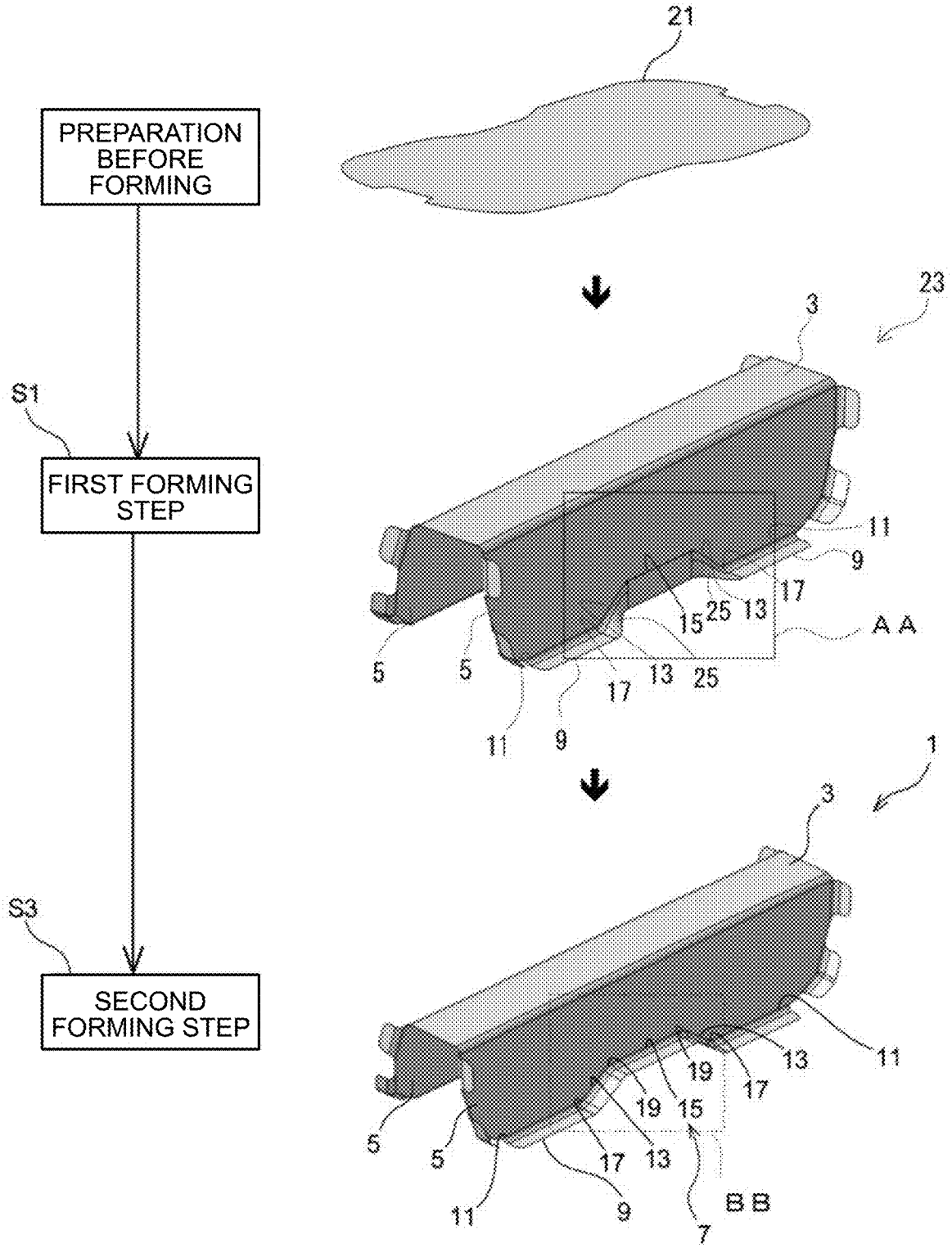
FIG. 1 is a view illustrating a press forming method according to an embodiment of the present invention.

As illustrated in FIG. 1, the press forming method according to the present embodiment includes: a first forming step S1 of forming a metal sheet 21 being a blank into a preformed part 23; and a second forming step S3 of forming the preformed part 23 formed in the first forming step S1 into a target shape. Each of the steps will be described below. In FIG. 1, the portions same as or corresponding to those in FIG. 6 illustrating the target shape are denoted by the same reference numerals.

<First Forming Step>

The first forming step S1 is a step of forming the preformed part 23. The preformed part 23 includes: a side wall portion 5; a flange portion 9 formed in a bottom edge 11 being a portion having a large wall depth and in the first curved portion 17, and a torsional shape portion 25 formed in an inclined side portion 13 continuous from the flange portion 9 toward the second curved portion 19 in the target shape.

Figure 2:
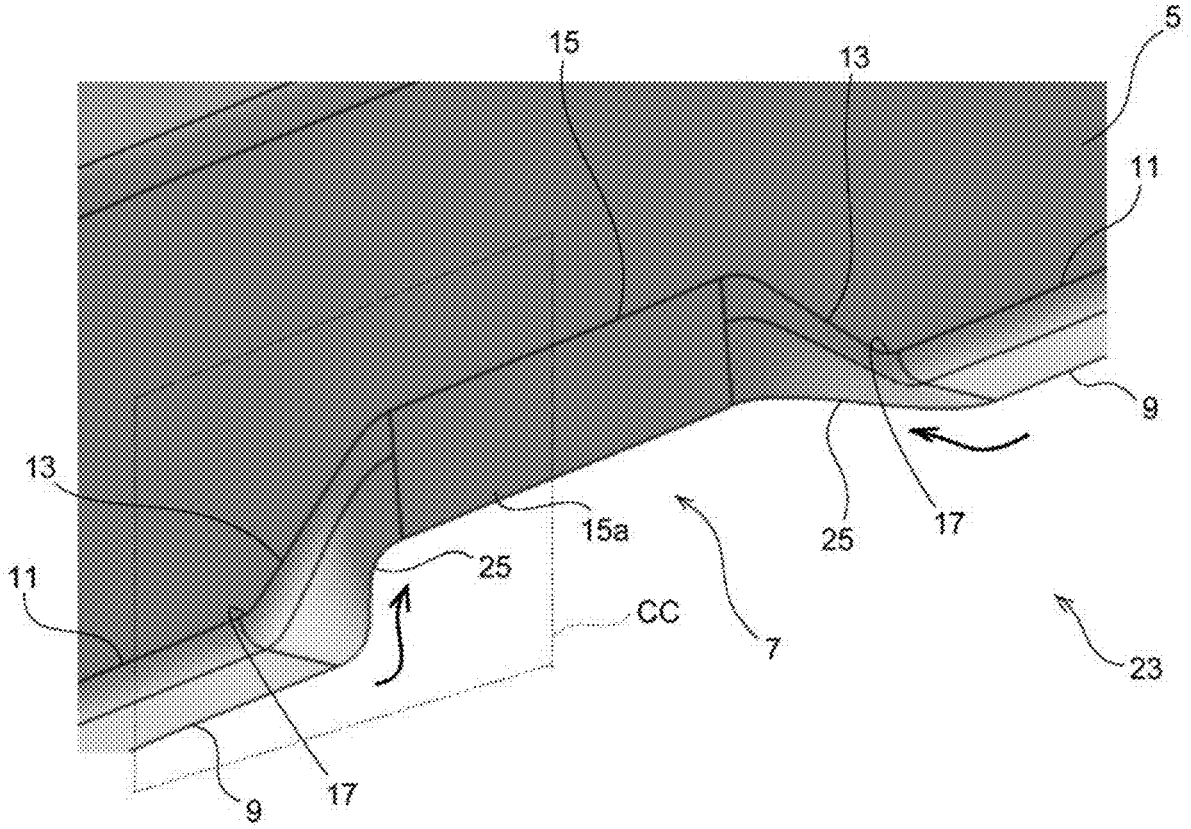
FIG. 2 is an enlarged view of portion AA of a preformed part in the first forming step in FIG. 1.

In the preformed part forming process in the first forming step S1, the flange portion 9 is formed in the bottom edge 11 being the portion having a large wall depth and in the first curved portion 17, but the torsional shape portion 25, instead of the flange portion 9, is formed in the inclined side portion 13. As illustrated in FIG. 2, the torsional shape portion 25 has one end side connected to the flange portion 9 formed in the first curved portion 17 while having the other end side connected to a blank end 15*a* before forming, resulting in forming the torsional shape. At the time of forming the torsional shape portion 25, as indicated by an arrow in FIG. 2, the metal inflow occurs from the flange portion 9 side of the first curved portion 17 to the torsional shape portion 25, alleviating the excess metal in the shrink flange forming, making it possible to suppress occurrence of wrinkles.

Figure 3:
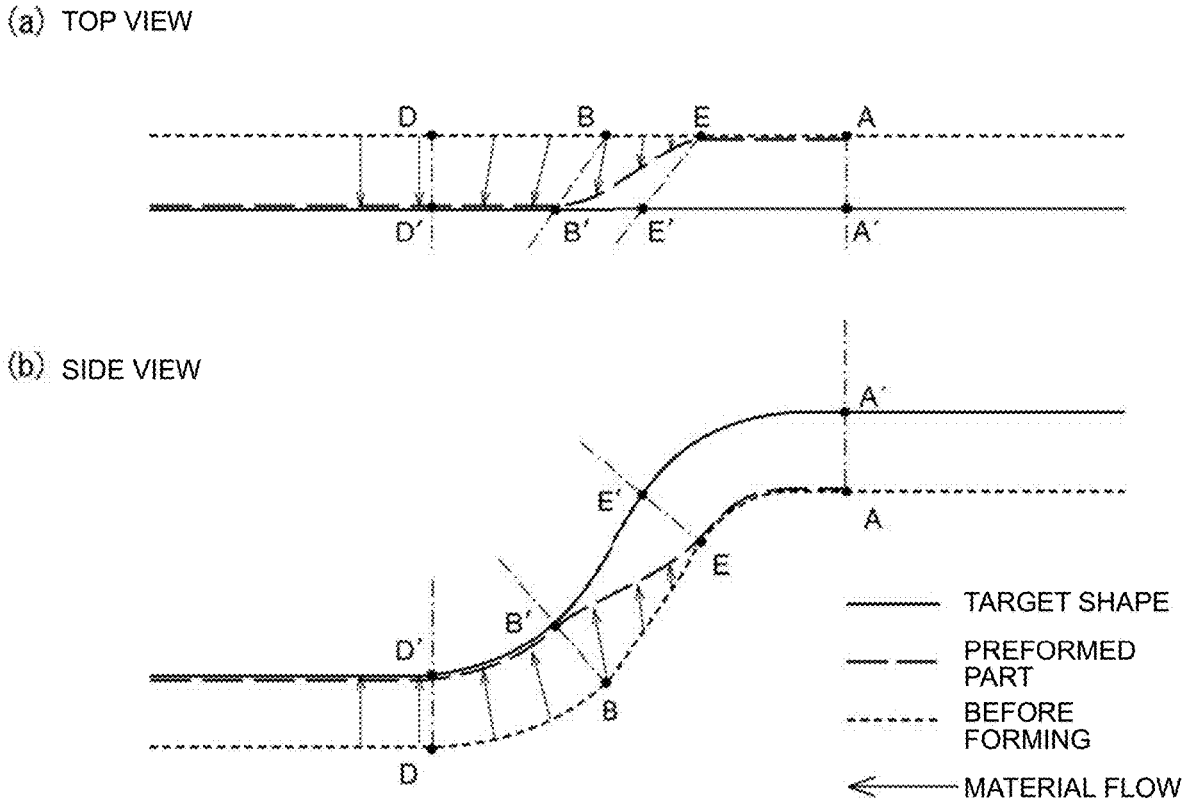
FIG. 3 is a view illustrating a mechanism of suppressing occurrence of wrinkles in the first forming step.

A mechanism of occurrence of the material flow will be described with reference to FIG. 3. FIG. 3 is a view illustrating the material flow in the forming process in portion CC surrounded by the broken line in FIG. 2, illustrating a top view and a side view of the preformed part 23 in FIG. 2. In FIG. 3, a fine broken line is an edge of the blank before forming, a coarse broken line is an edge of the preformed part 23, and a solid line is an edge of the flange portion 9 in the target shape. Points A to E and points A' to E' in the drawing are the same as those illustrated in FIG. 7. That is, point A is an R-finish of the second curved portion 19 in the blank, and is a tip position or the torsional shape portion 25. Point B is a point corresponding to one R-finish (refer to FIG. 7) of the blank portion having occurrence of shrink flange forming in a conventional case, and point B' is an intersection of a straight line extending perpendicularly to the edge of the torsional shape portion 25 from point B in the side view and the edge of the torsional shape portion 25. Point D is an R-finish of the first curved portion 17 of the blank, and point D' is an intersection of a line perpendicular to the edge of the target shape from point D in the side view and the edge of the target shape.

Due to the shrink flange forming, the distance from point B' to point D' is shorter than the distance from point B to point D (B'D'<BD), and wrinkles are likely to occur in the first curved portion 17 due to the excess metal caused by formation of the flange portion 9. On the other hand, since the distance from point A to point B' is longer than the distance from point A to point B (AB'>AB) in a three-dimensional view, the material is pulled toward point A and flows while deviating from "substantially perpendicular to the ridge line" illustrated in portion a of FIG. 7. Therefore, the material flow indicated by the arrow in FIG. 3 is generated, the material flow being closer to point A as compared with the conventional material flow indicated by the arrow in the wrinkle occurrence region in FIG. 7. This material flow alleviates the excess metal in shrink flange forming at the first forming step S1, leading to prevention of occurrence of wrinkles.

Figure 8:
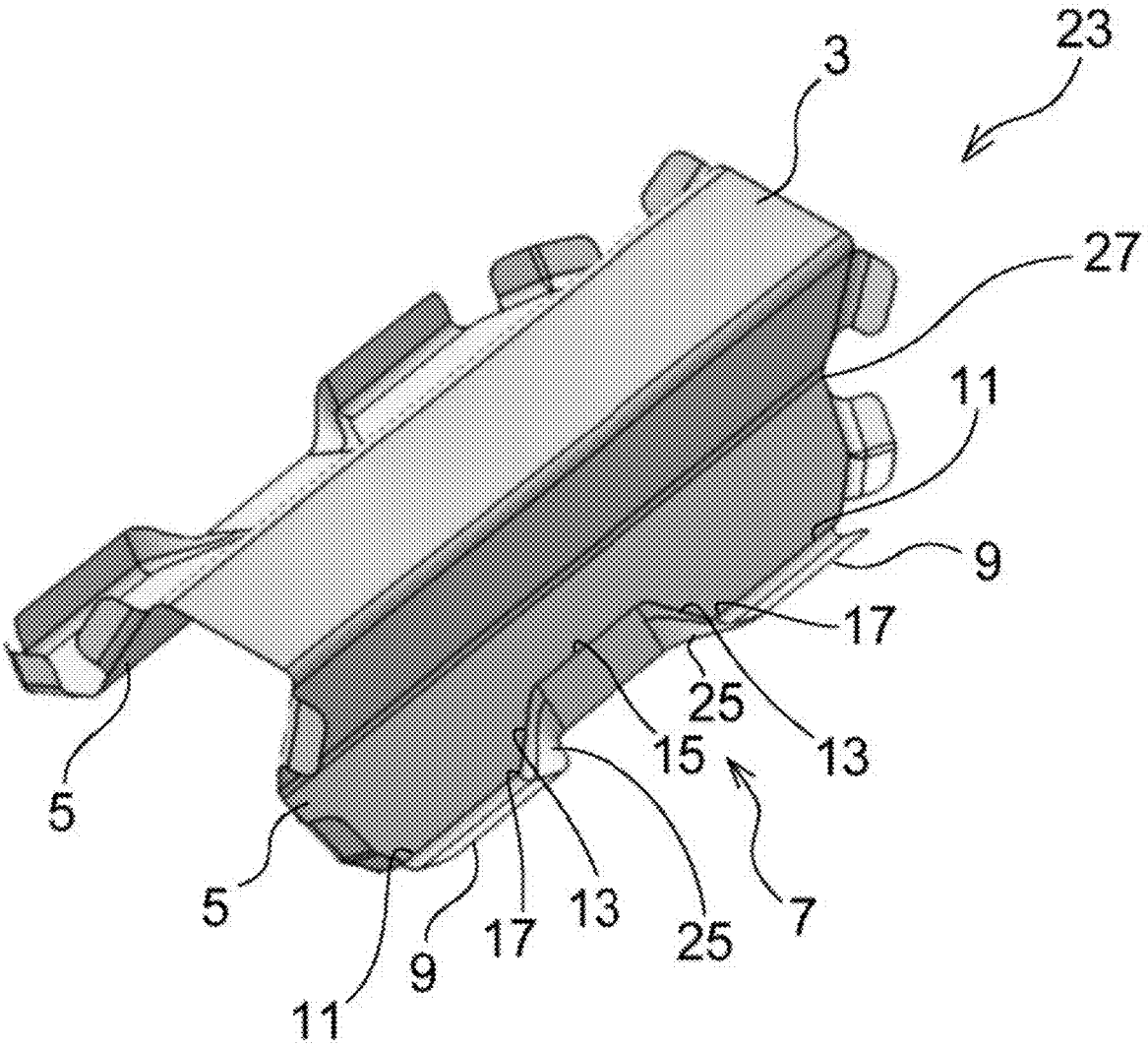
FIG. 8 is a view illustrating another example of the preformed part in FIG. 1.

In the first forming step S1, as illustrated in FIG. 8, a bending portion 27 may be formed at an intermediate portion of the side wall portion 5 in the height direction having an angle at which the opening side of the side wall portion 5 opens outward. The reason for this is as follows. In application of the present invention, forming the flange portion 9 while the side wall portion 5 is kept vertical would increase a bending angle between the side wall portion 5 and the flange portion 9 due to springback, leading to high probability of occurrence of curl in the side wall portion 5. By forming the bending portion 27, the flange portion 9 can be formed with a tool having a downward V-shaped tip. This makes it possible to have a sharp bending angle between the side wall portion 5 and the flange portion 9, and possible to decrease the height of the side wall portion 5 adjacent to the flange portion 9, leading to suppression of the curl. As a result, it is easy to form only a part of the flange portion 9, that is, only the shrink flange forming portion.

<Second Forming Step>

The second forming step S3 is a step of forming the torsional shape portion 25 of the preformed part 23 formed in the first forming step S1 into the flange portion 9, and forming the flange portion 9 in the second curved portion 19 continuous from the inclined side portion 13 and in the recessed side portion 15 having a small wall depth so as to achieve formation of a target shape. In the forming process of the second forming step S3, as indicated by the arrow in FIG. 4, by returning the torsion from the torsional shape portion 25 that has absorbed the excess metal in FIG. 2, the excess metal causes the metal inflow into the stretch flange forming portion, alleviating the material shortage of the stretch flange forming portion, leading to suppression of occurrence of fracture.

Figure 4:
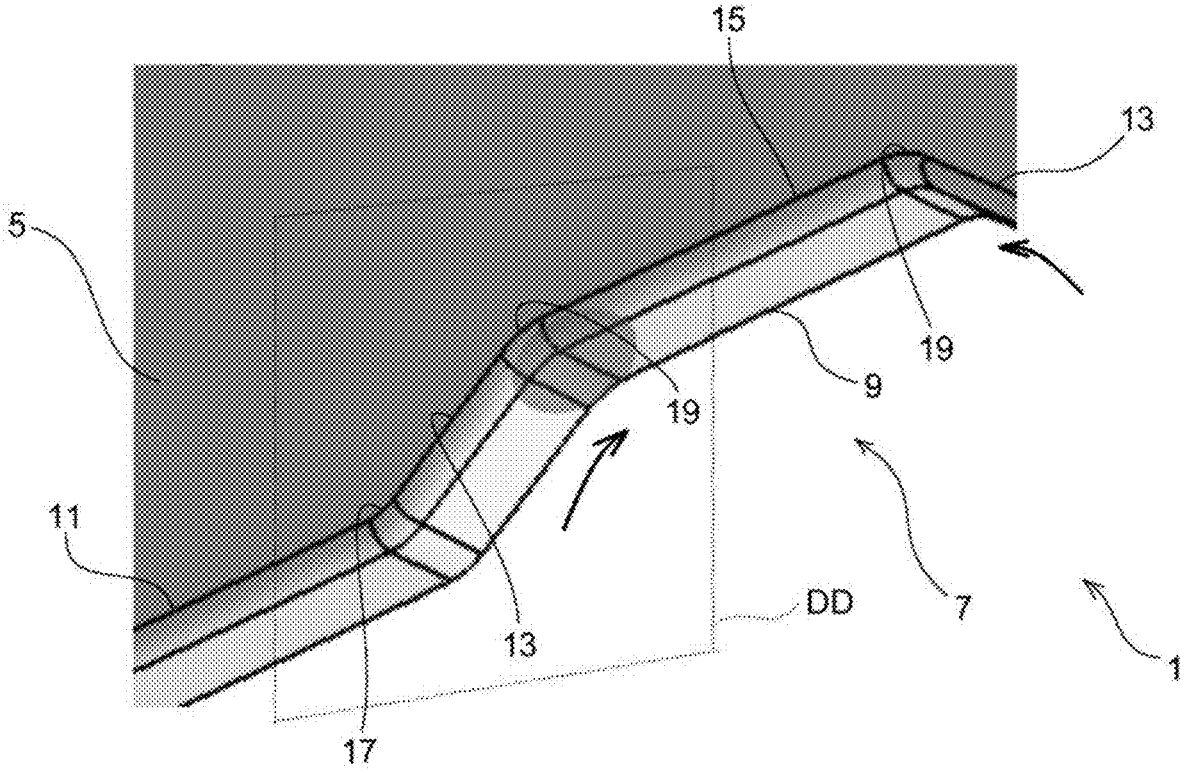
FIG. 4 is an enlarged view of portion BB of a target shape in the second forming step in FIG. 1.
Figure 5:
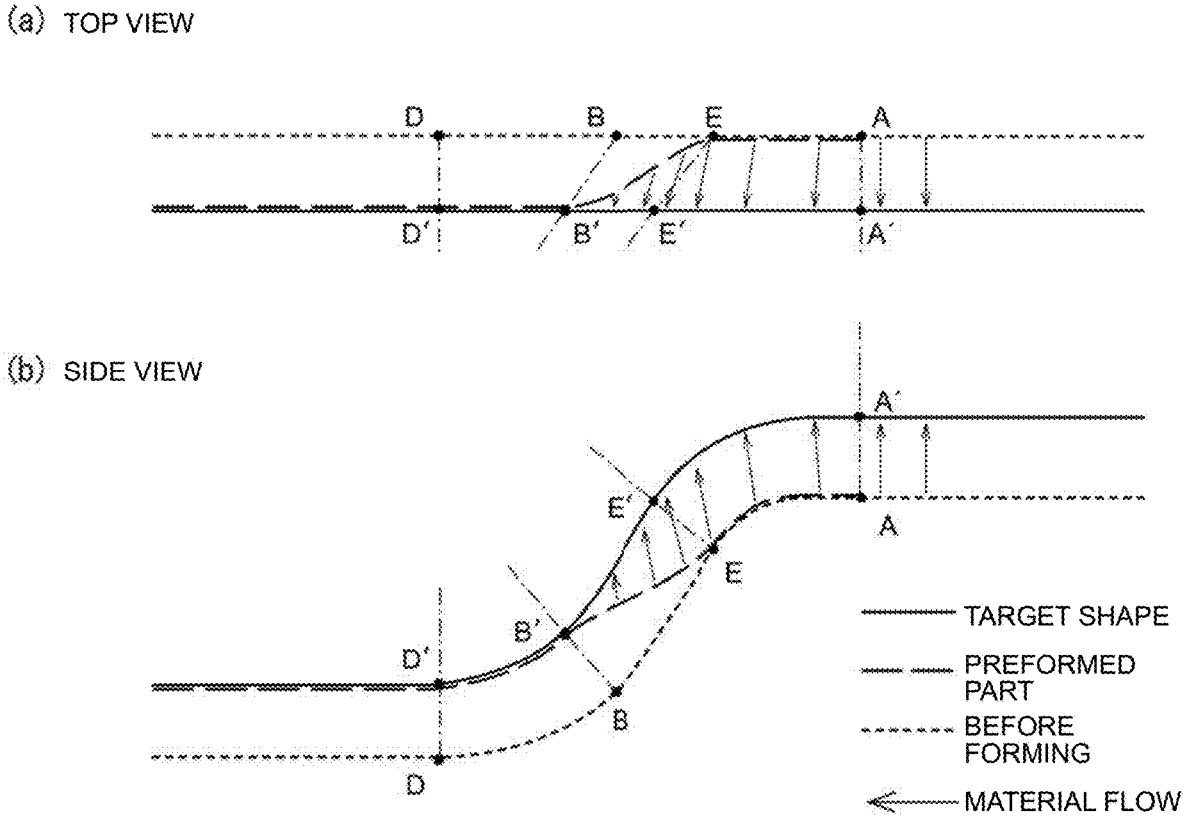
FIG. 5 is a view illustrating a mechanism of suppressing occurrence of fractures in the second forming step.

A mechanism of occurrence of the material flow will be described with reference to FIG. 5. FIG. 5 is a view illustrating the material flow in the forming process of the DD portion surrounded by the broken line in FIG. 4, illustrating a top view and a side view of FIG. 4. In FIG. 5, a fine broken line is an edge of the blank before forming, a coarse broken line is an edge of the torsional shape portion 25, and a solid line is an edge of the flange portion 9 in the target shape. In addition, points A to E and points A' to E' in the drawing are the same as those illustrated in FIG. 7.

Due to the stretch flange forming, the distance from point A' to point E' is longer than the distance from point A to point E (A'E'>AE), and the material shortage due to the forming of the flange portion 9 is likely to cause an occurrence of fractures in the second curved portion 19. On the other hand, since the distance from point D' to point E' is shorter than the distance from point D' to point E (D'E'<D'E) in a three-dimensional view, the material is pushed toward the A' side and flows while deviating from "substantially perpendicular to the ridge line" illustrated in portion b in FIG. 7. Therefore, the material flow indicated by the arrow in FIG. 5 is generated, the material flow being closer to point A' as compared with the conventional material flow indicated by the arrow in the fracture occurrence region in FIG. 7. This material flow alleviates the material shortage in the stretch flange forming at the second forming step S3, leading to prevention of occurrence of fractures.

As described above, in the present embodiment, only the portion of occurrence of the shrink flange forming is formed first during the first forming step S1, and the torsional shape portion 25 that promotes the material flow toward the portion of occurrence of the stretch flange forming is formed in the forming process. Next, the second forming step S3 forms the torsional shape portion 25 into the second curved portion 19, and forms a portion that becomes the stretch flange forming. With this operation, the material flow from the torsional shape portion 25 can suppress material shortage due to stretch flange forming, achieving formation of a target shape.

In this manner, by interposing the forming of the torsional shape portion 25 in the middle of forming, the strain of the dangerous portion where the shrink flange wrinkles occur and the strain of the dangerous portion where the stretch flange fractures occur are dispersed. With this configuration, occurrence of wrinkles due to shrink flange forming is suppressed in the first forming step S1, and occurrence of fractures due to stretch flange forming is suppressed in the second forming step S3, leading to achievement of suppression of occurrence of wrinkles and fractures throughout all steps.

The first forming step and the second forming step of the present invention may be formed with different dies. Alternatively, the first forming step and the second forming step can be performed with one die.

EXAMPLE

In order to confirm the effect of the present invention, press forming was performed using a floor front cross member as illustrated in FIG. 6 as a target shape. The material was a steel sheet having a tensile strength of 1180 MPa-class and a thickness of 1.4 mm. First, as Comparative Example, a target shape was formed in one step without forming the preformed part 23, and press forming was performed by a method of crash forming by using pad, in which the top portion was held with a pad. Next, as an example of the present invention, press forming was performed including the first forming step S1 of forming the preformed part 23 in which only the shrink flange forming portion and the second forming step S3 of forming the preformed part 23 into a target shape, which are described in the embodiment, with each forming step performed by a method of crash forming by using pad, in which the top portion was held with a pad.

In the case of Comparative Example, wrinkles occurred in portion a and fractures occurred in portion b illustrated in FIG. 6, and the target shape was not successfully obtained. In contrast, in Example of the present invention, the press forming part 1 of high quality was successfully obtained with no fracture or wrinkles in the flange portion 9. As described above, the present invention is proven to be effective for suppressing stretch flange fracture and shrink flange wrinkles in formation of a press forming part having a flange portion and a greatly changing side wall depth.

INDUSTRIAL APPLICABILITY

According to the present invention, it is possible to provide a press forming method applicable to a press forming part having an occurrence of wrinkles and fractures in a flange itself and capable of simultaneously suppressing the wrinkles and fractures occurring in the flange.

REFERENCE SIGNS LIST

1 PRESS FORMING PART
3 TOP PORTION

5 SIDE WALL PORTION
7 RECESSED PORTION
9 FLANGE PORTION
11 BOTTOM EDGE OF DEEP PORTION
13 INCLINED SIDE PORTION
15 RECESSED SIDE PORTION
15*a* BLANK END
17 FIRST CURVED PORTION
19 SECOND CURVED PORTION
21 METAL SHEET
23 PREFORMED PART
25 TORSIONAL SHAPE PORTION
27 BENDING PORTION

The invention claimed is:

1. A press forming method for forming a press forming part, the press forming part including: a top portion; a side wall portion continuous from the top portion, the side wall portion having a recessed portion in which a bottom edge, which is an end on an opposite side of the top portion in a side view, is recessed toward the top portion; and a flange portion formed outward on the bottom edge of the side wall portion, the recessed portion including a first curved portion continuous with the bottom edge being a portion having a large wall depth, an inclined side portion continuous with the first curved portion, a second curved portion continuous with the inclined side portion, and a recessed side portion having a small wall depth, arranged in order from the bottom edge being a portion having a large wall depth, the flange portion being formed such that the flange portion formed in the first curve portion becomes a shrink flange while the flange portion formed in the second curved portion becomes a stretch flange, the press forming method comprising:

a first forming step of forming a preformed part, the preformed part including the top portion, the side wall portion, the flange portion formed in the bottom edge being a portion having a large wall depth and a torsional shape portion formed in the inclined side portion continuous from the flange portion to each the second curved portion; and a second forming step of further processing the preformed part formed in the first forming step, including processes of forming the torsional shape portion into the flange portion and forming the flange portion in the second curved portion continuous from the inclined side portion and in the recessed side portion having a small wall depth so as to achieve formation of the press forming part.

2. The press forming method according to claim 1, wherein the first forming step and the second forming step are performed by using different dies.

3. The press forming method according to claim 1, wherein the first forming step and the second forming step are performed with one die.

* * * * *